US007302733B2

(12) United States Patent
Rau et al.

(10) Patent No.: US 7,302,733 B2
(45) Date of Patent: Dec. 4, 2007

(54) FLOOR CLEANING MACHINE USING MICROFIBER PAD

(75) Inventors: Michael A. Rau, Eden Prairie, MN (US); Jesse V. Mondigo, Aurora, IL (US); David R. Holly, Brooklyn Park, MN (US); Jeffrey W. Pollack, Joliet, IL (US)

(73) Assignee: Minuteman International, Inc., Addison, IL (US)

( * ) Notice: Subject to any disclaimer, the term of this patent is extended or adjusted under 35 U.S.C. 154(b) by 0 days.

(21) Appl. No.: 11/223,854

(22) Filed: Sep. 8, 2005

(65) Prior Publication Data

US 2006/0048331 A1 Mar. 9, 2006

Related U.S. Application Data

(60) Provisional application No. 60/609,116, filed on Sep. 9, 2004.

(51) Int. Cl.
*A47L 7/00* (2006.01)

(52) U.S. Cl. ..... 15/320; 15/340.4; 15/380; 15/381; 15/384; 15/385; 15/347

(58) Field of Classification Search ..... None
See application file for complete search history.

(56) References Cited

U.S. PATENT DOCUMENTS 4,369,544 A * 1/1983 Parisi ..... 15/320
5,287,581 A * 2/1994 Lo ..... 15/52
7,137,169 B2 * 11/2006 Murphy et al. ..... 15/320

* cited by examiner

*Primary Examiner*—David Redding
(74) *Attorney, Agent, or Firm*—Wildman, Harrold, Allen & Dixon LLP

(57) ABSTRACT

A cleaning machine for floors and carpets includes a vacuum pick-up in front of the machine for suctioning loose material and debris off the floor. A microfiber cleaning assembly is mounted beneath the machine for cleaning the floor following the vacuum pick-up. The microfiber cleaning element may be motor driven. A source of solution delivers a controlled amount of solution or water to moisten the microfiber cloth. A vacuum motor provides suction to the forward vacuum pick-up, routes the suctioned air through a filter, and the filtered air is then delivered to an air diffuser to dry any residual moisture behind the microfiber cleaning assembly. The microfiber cleaning assembly may have two offset pads driven by a reciprocating or oscillating drive, or one or two cylindrical rollers for receiving and securing the microfiber fabric in the form of a sleeve.

6 Claims, 6 Drawing Sheets

FLOOR CLEANING MACHINE USING MICROFIBER PAD

RELATED APPLICATION

This application claims the benefit of U.S. Provisional Application No. 60/609,116 filed on Sep. 9, 2004 for "FLOOR CLEANING MACHINE USING MICROFIBER PAD".

FIELD OF THE INVENTION

The present invention relates to hard floor and carpet cleaning machines; and more particularly, it relates to a floor cleaning machine using microfiber cleaning fabric for engaging and scrubbing the floor or other surface to be cleaned.

BACKGROUND OF THE INVENTION

One widespread procedure for cleaning floors commercially requires that the floor be pre-swept or vacuumed, normally by hand, prior to using a floor scrubbing or carpet extraction machine to clean the surface. Automatic floor scrubbers and carpet extraction machines typically use a water spray or gravity feed from a solution tank applied directly to the floor (after the loose dirt and debris are removed manually or by a separate vacuum machine), followed by a series of brushes which may include cylindrical scrub brushes, a group of disc scrub brushes or a combination of the two, to work the solution into the floor and loosen dirt and debris.

Following the brushes, a squeegee or vacuum suction device recovers the spent solution from the floor, and returns it to a separate tank which is commonly referred to as the recovery tank. Automatic scrubbing machines of this type, if used in an area in which there is a lot of loose dirt and debris, as indicated, generally require separate vacuuming, sweeping or dusting of the area before scrubbing. If the area is of substantial size, these two operations, pre-removal of loose material followed by machine scrubbing, may consume considerable time and require the use of a separate pre-removal machine and then application of a scrubbing machine. Moreover, automatic floor scrubbers are expensive, particularly more current machines such as rider/scrubbers.

At least one rider/scrubber does have a dual sweeping/scrubbing capacity, with a forward-sweeping cylindrical brush for sweeping loose debris into a forward hopper, followed by a rear scrub deck with two or more disc scrub brushes. A rear squeegee recovers the dirty solution, which is stored in a recovery tank and must be discharged into a drain. Such machines use a considerable amount of solution and may leave a substantial amount of water behind the scrub deck. The spent solution is recovered and stored on the machine, to be discarded after a cleaning run.

For scrubbing machines designed for application to larger areas, the size of the machine may be limited by design constraints such as maneuverability and the need to provide operator visibility of the floor area in front of the machine. Currently, in the case of battery-operated scrubbing machines, the physical size of a typical battery pack may occupy a substantial portion of the overall machine. Another factor in determining the size of the machine is the volume of cleaning solution that the machine is capable of storing and which is recovered and stored until discarded. As mentioned, the cleaning solution, after application to the floor and operation of the scrub brushes, is typically recovered by suction and stored in the same machine until discarded. The machine must be moved or driven to an area where the dirty water may be discharged. The presence of two separate tanks, one for clean solution and one for spent solution acts as a limitation on the total area the machine may treat before the need to replace the clean solution and discharge the dirty solution. However, the size of the tanks are restrained because of the overall size limitations on the machine for practical reasons, and the presence of bulky batteries.

Various arrangements, including the use of a movable wall in a combination cleaning solution/recovery solution double-tank system, have been employed to overcome the space limitation problem of storing sufficient volumes of solution and recovered water. Nevertheless, the size of the typical commercial scrubbing machine has limited the area which the machine may clean before returning to the supply closet to discharge the spent solution and to place additional clean solution in the clean solution tank. Thus, the size of the solution tanks as well as the volume assumed by the batteries act to limit the application area of a conventional cleaning machine, even if the cost of the machine were not a factor.

SUMMARY OF THE INVENTION

The present invention employs a microfiber cleaning element which is removably attached to a pad driver or mounted on one or more rollers. As used herein, the term "microfiber" is intended to be broad, including ultra-fine manufactured fibers having a weight of less than approximately 1.0 denier. Cloth-like fabrics made from microfiber fibers have a gentle drape and are known to have cleaning capability. Currently, microfiber fabrics are made from acrylic, nylon, polyester and rayon; but the term as used herein is not limited to these materials.

The pad driver or rollers may be driven by a motor. The pad driver may include a pair of pad drivers, each equipped with a microfiber pad driven by a reciprocating or oscillating electrical drive motor. Water is added to the microfiber element to keep it moist.

The machine includes a vacuum head or pick-up shoe, which also may be provided with microfiber pads for engaging the floor. The vacuum shoe is located in front of the machine (i.e. a pre-vacuum), and extends the width of the machine, suctioning loose debris and dirt in front of the principal microfiber cleaning element. The loose debris and dirt is entrained in the vacuum air stream and passed through a filter. The filter removes and collects all particles, dust and debris; and the filtered air is then returned to the floor behind the microfiber cleaning element to dry any residual solution film or moisture that may be on the floor.

The microfiber cleaning element may be in the form of a pad including a water-permeable backer or stiffener so that the microfiber cloth at the bottom of the pad which engages the floor is made semi-rigid in the sense that it may accommodate, under the application pressure of the pad driver, to variations in the contour of the floor, but the pad itself is not flimsy, such as a cloth layer alone might be. Preferably, in the case of a pad, the microfiber filter material is secured, as by stitching or the like to a water-permeable backing surface which then is engaged by or secured to the pad driver.

The pad assembly is capable of receiving and passing water and cleaning liquid to keep the microfiber fabric moist. The width of the machine in one illustrated embodiment may be in the range of seventeen to thirty-six inches (slightly larger than the width of the cleaning pads), and the machine would then include a vacuum shoe having a width of twenty to thirty-eight inches (also slightly larger than the width of the cleaning swath of the machine which is, of course, determined by the width of the microfiber cleaning element in contact with the floor). The front or pre-vacuum shoe would have an operating width slightly greater than the width of the microfiber cleaning element.

The machine includes a solution tank for storing the cleaning solution. Although there is no need for the type of recovery solution tank in current floor scrubbers, one of the embodiments include provisions for rinsing the microfiber fabric during operation; in which case, the spent rinse solution is recovered by vacuum and stored on board until discarded.

A solution feed system applies a controlled amount of water to the microfiber fabric. In one illustrated embodiment, the cleaning solution is fed to the microfiber fabric through apertures in the pad driver. The solution may also be in the form of a spray or a mist. In any case, however, the amount of water applied to the microfiber cleaning element is sufficient to keep the microfiber fabric moist. The purpose of the solution is to keep the contact surface of the microfiber fabric moist, but not dripping wet. It is the moistened microfiber fabric itself which does the primary cleaning.

By applying a controlled amount of solution to the microfiber fabric during operation such that no substantial amount of residual water is left following operation of the microfiber cleaning element, there is no need to have a vacuum recovery system to recover water behind the machine. The air of the pre-vacuum, after passing through a filter, may be returned as exhaust air behind the microfiber cleaning element, and directed onto the cleaned surface behind the machine, to evaporate any residual moisture left by the microfiber cleaning element so that the operator continues to walk on a clean, dry surface, rather than a wet floor.

In a second embodiment of the invention, the microfiber cleaning element is in the form of a sleeve or sock placed on a cylindrical roller or drum which is driven in rotation by a motor. The solution metering pump meters solution from a source on the machine to the microfiber cleaning element. As the roller rotates, a wet vacuum vacuums the contact surface of the microfiber sleeve on the roller, and returns recovered material to a waste tank on the machine. In this manner, the microfiber fabric is kept moist, and it is also cleaned and rinsed repeatedly, keeping the cleaning element in more effective cleaning condition, by the rinse and vacuum system.

In still another embodiment, the microfiber cleaning element is in the form of a larger sleeve, fitting over two cylindrical rollers, located in fore and aft positions relative to the direction of travel of the machine. One of the rollers may be driven. Again, a rinse solution is applied to the microfiber cleaning element at a location between the two rollers, and the rinse solution is recovered by vacuum, leaving enough solution to maintain the desired moisture level of the microfiber cloth.

In both of the later two embodiments, using cylindrical rollers to support and operate the microfiber cleaning element, there preferably is a pre-vacuum element in front of the machine, the discharge of which is filtered and then routed back behind the microfiber cleaning assembly for drying any residual moisture that may remain on the floor after cleaning.

In still another embodiment, the microfiber element is provided in the form of a source roll of fabric, and the microfiber fabric is fed from the source roll in partial wrapping engagement about the bottom of a cylindrical support roll which may be driven by a motor. The microfiber cleaning element is then gathered by a rotating take-up roll on the opposite side of the cylindrical support roll. Again, a controlled amount of moisture is applied to the microfiber cleaning element itself or the floor before the microfiber cleaning element contacts the area, to maintain the desired moisture level of the microfiber fabric. In this embodiment, after the microfiber fabric is completely spent, the machine notifies the operator who then shuts the machine down, removes the dirty or spent roll from the machine and replaces the used roll with a clean roll of microfiber cleaning material.

Persons in the cleaning business will immediately appreciate some of the advantages of the present invention. First, a single pass of a machine removes all loose dirt and debris. Secondly, in the same pass, a cleaning element scrubs the floor clean and leaves little residual water after operation. The size of the machine in one embodiment may thus be reduced for a given application area because there is no need to store recovery solution, or, conversely, the design application area for a given machine may be increased because of the size constraints discussed above. Third, the machine may be simple and inexpensive. No adjustments are necessary during operation. In fact, it is desirable not to leave the operator with the ability to control the amount of solution applied to the microfiber element. The machine uses simple principles familiar to operators of cleaning machines, namely, a vacuum recovery head with a vacuum bag or other filtering system, a conventional vacuum motor, and an air diffusion device for returning the suction air back to the floor behind the microfiber pad.

Leaving the floors virtually dry immediately after the machine passes provides an obvious maintenance and safety feature in that the area may be accessible to consumers or workers immediately after cleaning.

Persons skilled in the art will be able to recognize other features and advantages of the present invention from the following description of an illustrated embodiment, accompanied by the attached drawing wherein identical reference numerals will refer to like parts in the various views.

DETAILED DESCRIPTION OF THE ILLUSTRATED EMBODIMENTS

Figure 1:
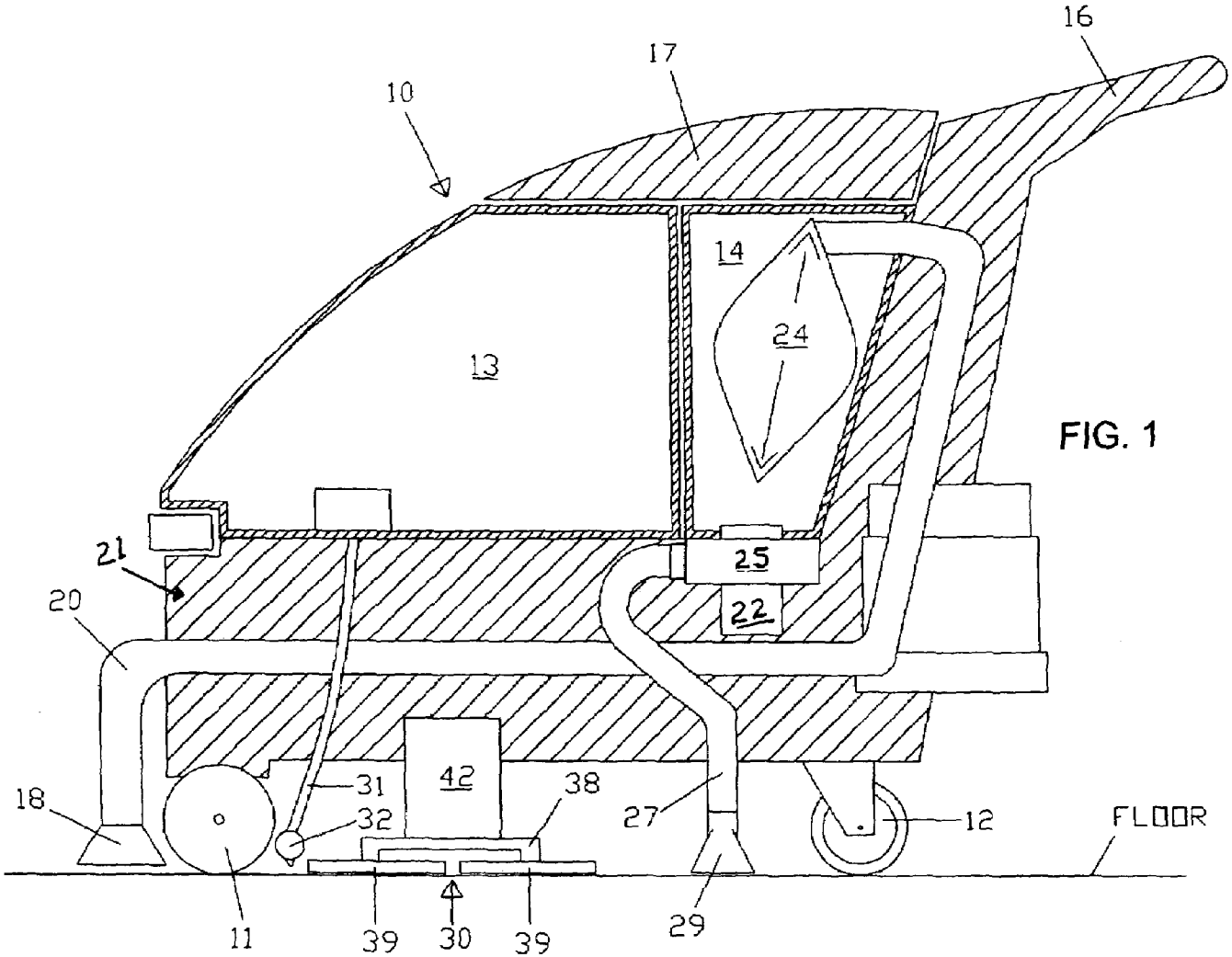
FIG. 1 is a sectional side schematic view taken along a vertical plane extending in the direction of travel of a floor cleaning machine using microfiber pads.

Referring first to FIG. 1, reference numeral 10 generally designates a floor cleaning machine using a microfiber cleaning element in the form of a pad. Machine 10 includes a pair of front support wheels, the left one of which is designated 11, and a pair of rear caster wheels, the left one of which is seen in FIG. 1 and designated 12. In smaller machines, the machine is designed to be pushed with the rear wheels being caster wheels, but in larger machines, the front or rear wheels may be traction driven, if desired.

The machine 10 includes a solution tank 13 and a waste tank 14 located behind the solution tank 13. The operator stands to the right of the machine as shown (that is, to the rear of the machine), where he has access to controls on a control panel 15, and controls the machine using a handle 16.

At the front of the machine, adjacent the floor, there is a vacuum pick-up nozzle 18 which is coupled to the waste tank or suction housing 14 by means of a conduit 20. The vacuum nozzle 18 may include forward and rear bristles 19 (FIG. 2) engaging the floor for loosening dirt and debris and promoting confinement while the suction system evacuates loose material from within the vacuum nozzle 18 (see FIG. 2).

The waste tank 14 is sealed by a removable cover 17; and a suction fan or blower 22 generates a subatmospheric pressure within the waste tank 14, thereby drawing air from the vacuum nozzle 18 through the conduit 20 and into the waste tank 14. A filter, in the form of a cloth bag for example, and designated 24, traps solids and particles and permits the filtered air to pass through a lower housing 25 of the waste tank 14 and into a conduit 27 where the discharged air is forced through an exhaust nozzle 29 onto the floor F, behind the microfiber cleaning assembly which is generally designated 30.

Fluid from the solution tank 13 (which may be either water or a solution of water and cleaning chemical) is fed from a supply hose 31 to a spray manifold with nozzles 32 which extends in front of the cleaning assembly 30 to wet the floor prior to cleaning by the microfiber cleaning element. Alternatively, the spray manifold 32 may be directed to spray the cleaning solution 34 more directly on the microfiber cleaning elements because the purpose of the liquid is to maintain the microfiber fabric moist to enhance its cleaning ability.

Figure 2:
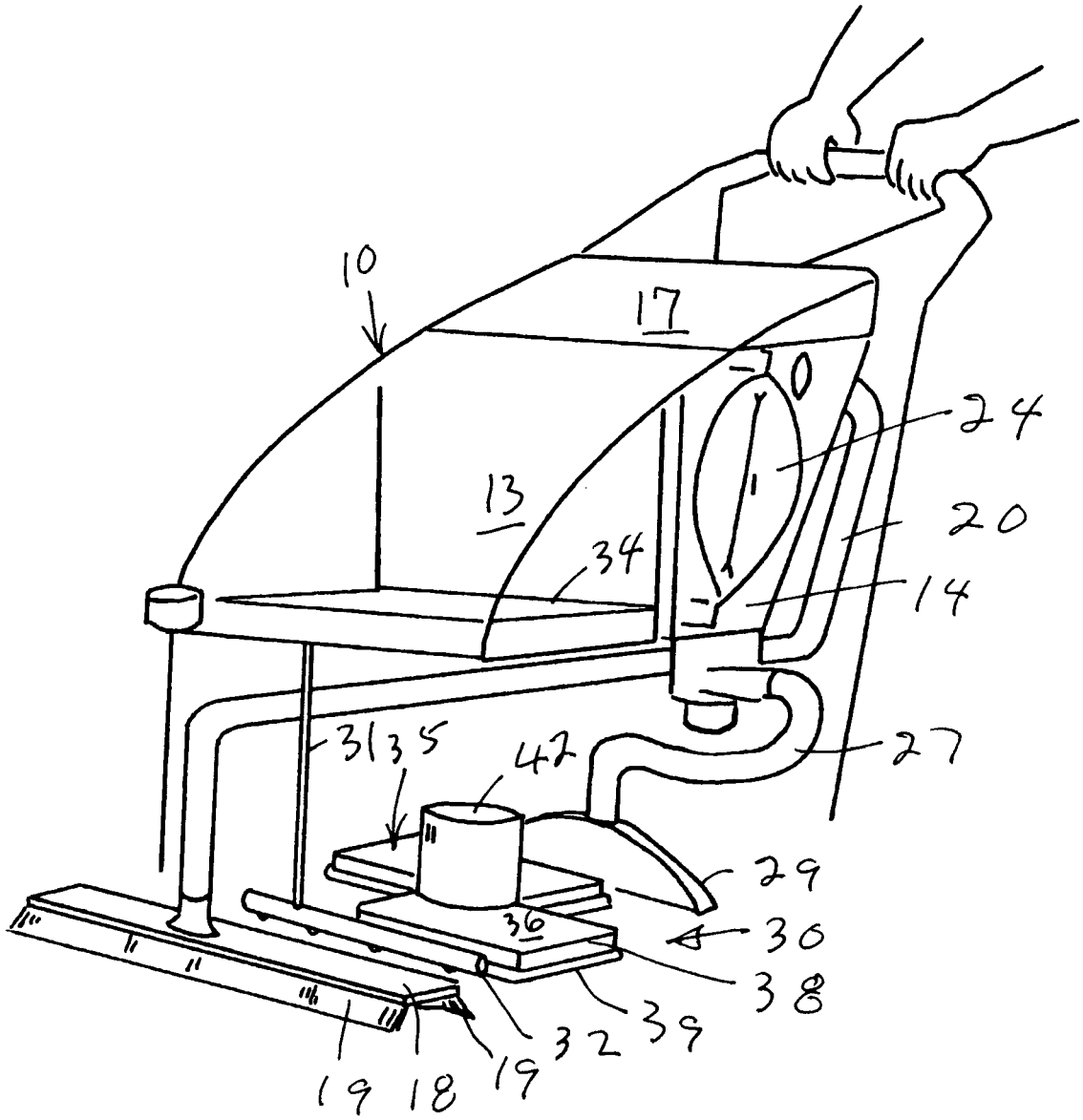
FIG. 2 is a frontal perspective view taken from the upper left side of the machine of FIG. 1, with portions of the housing omitted to show the cleaning elements.

Turning now to FIG. 2, the microfiber cleaning assembly 30 includes first and second pads 35,36 which are coupled together and spaced such that there is a lateral overlap, with pad driver 36 spaced forwardly and to the side of the pad 35. Each pad may be similar, including a pad support element such as that designated 38 for pad 36, and a microfiber pad 39. Microfiber cloth may be affixed to the pad driver, as by stitching so that the complete pad driver is replaced when dirty. The pads 35,36 are driven by a motor 42. The motor 42 may be of the type which drives the pads, in unison, in a reciprocating or oscillating motion. Such motor drives are known.

Each of the microfiber pads 39 may be a composite formed from a bottom layer of microfiber fabric (which forms the actual floor contact and cleaning element) and a backing material such as a non-woven synthetic material which provides support and adds strength to the microfiber fabric, yet remains flexible. The pads are preferably removably mounted to the pad drivers to facilitate replacement. To summarize the operation of the embodiment of FIGS. 1 and 2, the microfiber pads are arranged in staggered relation but overlap slightly to define a single cleaning swath.

In front of the microfiber cleaning assembly, a pre-vacuum 18 collects loose material and debris and routes it to the tank 14 for collecting loose waste. The vacuumed air is filtered, and the filtered air is then directed onto the cleaned floor behind the microfiber cleaning assembly by the discharge nozzle 29.

The microfiber pads are secured to pad drivers, 38 which are driven as a unit by means of a reciprocating or oscillating drive motor 42. A controlled amount of solution is applied directly to the floor in the embodiment of FIGS. 1 and 2, but alternatively may be applied to the microfiber pads themselves, in an amount sufficient to keep the microfiber material moist but not dripping. The microfiber cleaning assembly then scrubs the floor and removes dirt and grime. The filtered, recovered air from the waste tank 14 is directed onto the floor behind the microfiber cleaning assembly so that the operator, and the rear support wheels 11 contact clean, dry floor without leaving streaks or residue.

Figure 3:
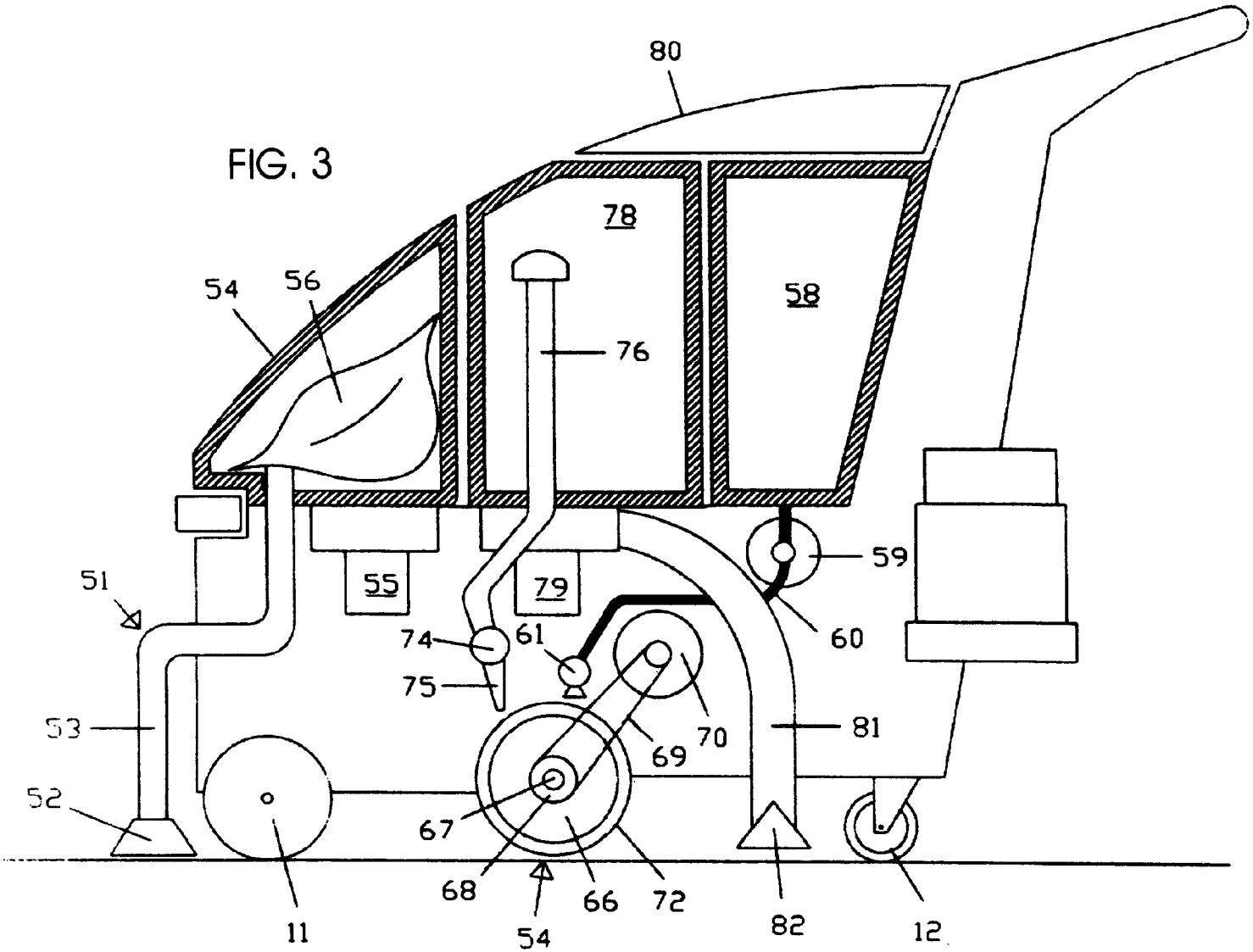
FIG. 3 is a schematic side view of a second embodiment of a floor cleaning machine using a microfiber cleaning element supported on the cylindrical roll.

Turning now to the embodiment of FIG. 3, it includes a pre-vacuum subsystem generally designated 51, and including a suction nozzle 52, a conduit 53 coupling the suction nozzle 52 to a vacuum housing 54 which is evacuated by a motor 55. A cloth bag filter 56 is located in the housing 55 to filter out dust, particles and other debris which is collected in the housing 54.

A solution tank 58 is mounted on the machine. A metering pump 59 receives solution from the tank 58 and passes a metered amount of solution into a conduit 60 which feeds a spray nozzle 61 located above a microfiber cleaning assembly 63. The pump 59 may be a positive displacement pump for accurate, controlled delivery of solution to the microfiber cleaning assembly.

The microfiber cleaning assembly includes a cylindrical roller 66 mounted on a shaft 67 which is equipped with a pulley 68 driven by a belt 69 which in turn is driven by a motor 70.

The rotation of the support roller 66 may be either clockwise as seen in FIG. 3 (in which case the microfiber cleaning element is moving in the direction of forward travel of the machine), or it may be moved counterclockwise as viewed in FIG. 3. In the embodiment of FIG. 3, the microfiber element support cylinder 66 is rotated in a counterclockwise direction. That is, the surface of the cleaning element 72 contacting the floor F moves toward the rear of the machine, opposite the direction of forward motion of the machine. Wrapped around the cylindrical support roll 66 is a microfiber cleaning element 72 in the form of a cylindrical sleeve carried, formed and driven by the roller 66. The cleaning element 72 may include an outer sleeve of microfiber material and a cylindrical support secured to the interior and sized to fit on the support cylinder 66.

In front of the spray nozzle 61, there is located a vacuum manifold 74 coupled to a vacuum nozzle 75. The vacuum manifold 74 is coupled to a conduit 76 which extends into a waste recovery tank 78 evacuated by a motor 79. Tank 78 is sealed by access lid 80 which also covers the solution tank 58.

In operation, the embodiment of FIG. 3 contains a pre-vacuum system 51 similar in function to that already described. Loose materials are suctioned up and the suctioned air is filtered, but not re-routed behind the machine. Rather, in the embodiment of FIG. 3, the waste recovery tank 78, which is a second vacuum housing, has its air (which may be filtered or screened) routed by means of a conduit 81 to a discharge nozzle 82 located behind the microfiber cleaning assembly 63 to dry any residual moisture left by the microfiber sleeve 72.

As dirt and grime are removed from the floor, it travels counterclockwise to the front of the microfiber cleaning element 72 as viewed in FIG. 3. At the top of the roller 66, cleaning solution 58 from tank in controlled amount sufficient only to keep the microfiber material moist is sprayed onto the microfiber fabric 72 across its entire width; and the cleaning solution and accumulated dirt are vacuumed up by the nozzle 75 and transported to, and captured within the waste recovery tank 78. Clean, filtered or screened air is returned to dry the swath cleaned by the microfiber cleaning element 63, thereby maintaining the microfiber sleeve 72 moist throughout operation, while continuously cleaning the microfiber fabric, thereby prolonging use time.

Turning now to the embodiment of FIG. 4, some of the elements are the same as those described in connection with the embodiment of FIG. 3, and those elements bear like reference numerals, and need not be further described for a complete understanding of the embodiment of FIG. 4.

Figure 4:
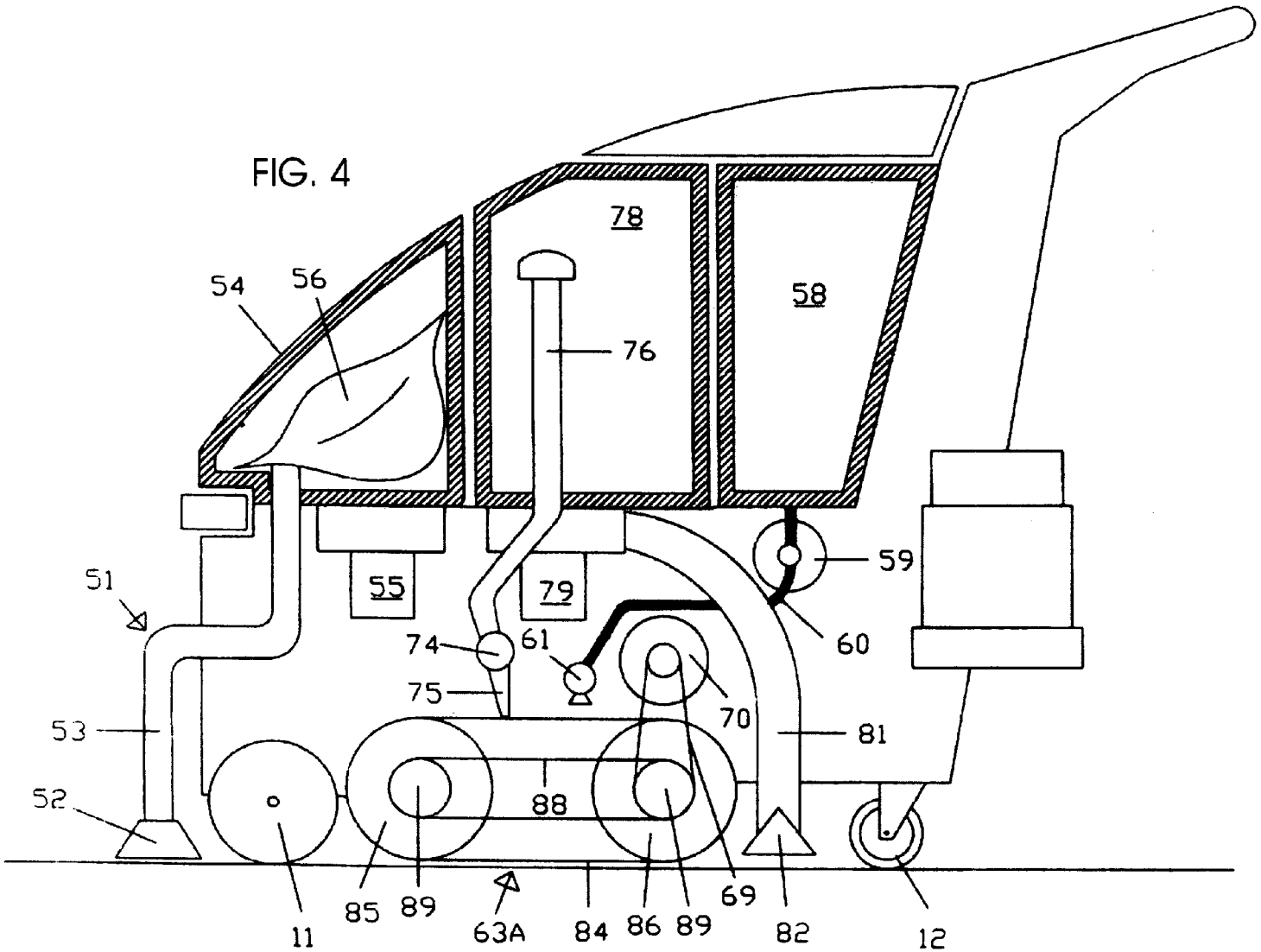
FIG. 4 is a left side view of a third embodiment of a floor cleaning machine using a microfiber cleaning element entrained around two cylindrical rolls located respectively in fore and aft positions.

In FIG. 4, there is provided a pre-vacuum subsystem 51 similar to that disclosed in connection with the embodiment of FIG. 3, a solution tank 58 and delivery system for solution including constant displacement pump 59 and spray nozzle 61, and a waste recovery tank 78, including a suction nozzle 75 and vacuum manifold 74.

In the embodiment of FIG. 4, the microfiber cleaning element 84, though in the general form of a sleeve, is larger in its peripheral length than in FIG. 3; and it is placed in wrapping engagement about two rollers 85, 86 which are driven by the motor 70 and coupled together by a belt 88 entrained about pulleys 89, connected respectively to shafts of the rollers 85, 86 so that the rollers are driven uniformly.

The embodiment of FIG. 4 has the advantage that the contact between the cleaning element and the floor is increased, particularly in the bottom portion of the rollers 85, 86, as well as the intervening section between the two pulleys. In this intervening section, if desired, boggy wheels or rollers may be used to provide more firm floor contact. The embodiment of FIG. 4 operates, otherwise, very similar to that described in connection with FIG. 3. The cleaning solution is applied to the contact surface of the microfiber cleaning belt 84 by means of the nozzle 61; and the rinse water and debris loosened thereby are suctioned away by the vacuum created in the waste recovery tank which is coupled to the nozzle 75 by means of the vacuum manifold 74 and conduit 76. The air from the waste recovery tank 78 is routed to a drying air nozzle 82 located behind the microfiber cleaning assembly 63A.

In the embodiment of FIG. 4, the area of contact between the microfiber cleaning element and the surface being cleaned is increased. Moreover, the use of a rinse and vacuum cleaning operation for the microfiber element during use increases the time during which the same cleaning element may be used for effective cleaning without changing the microfiber fabric.

Figure 5:
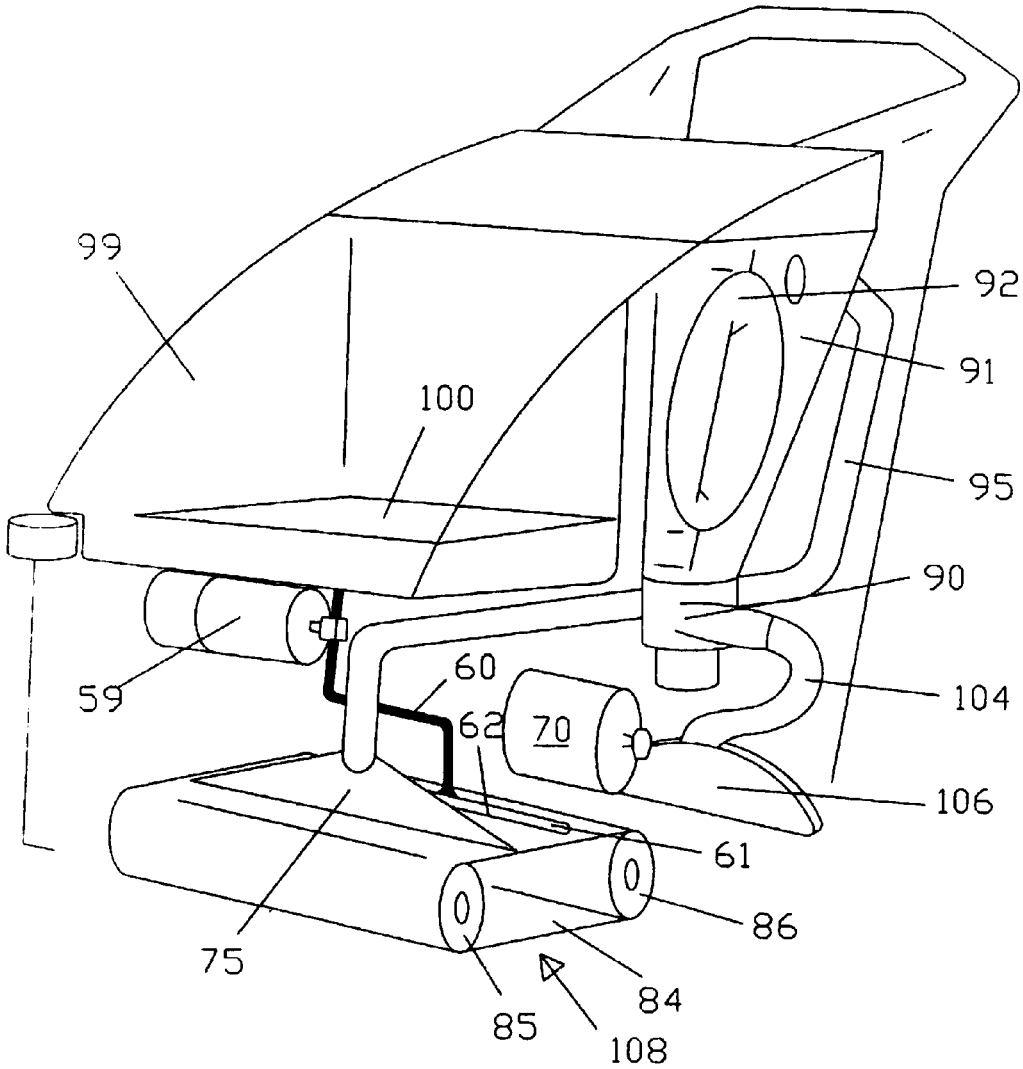
FIG. 5 is a left frontal perspective view of a modified version of the embodiment of FIG. 4.

Turning now to the embodiment of FIG. 5, it is similar to the embodiment of FIG. 4 except that both the pre-vacuum nozzle 52 is omitted, and the wet suction nozzle 75 is actuated by the vacuum motor 90 which evacuates a housing 91 in which there is mounted a filter bag 92. A conduit 95 is connected both to the pre-vacuum nozzle 52 and the wet suction nozzle 75, the later being located on the top side of the cleaning element 84 which is entrained about forward and rear rollers 85,86 which are driven by motor 90. As in FIG. 4, a constant displacement pump 59 meters cleaning fluid from a solution tank 99, the solution being designated 100, and feeds it through a conduit 60 to a distribution manifold 61 provided with spray nozzles 62.

Further, the outlet air of the suction motor 90 is fed through a conduit 104 to an air diffuser 106 located behind the microfiber cleaning assembly generally designated 108 in FIG. 5, and which may be similar to the microfiber cleaning assembly described in connection with FIG. 4.

Figure 6:
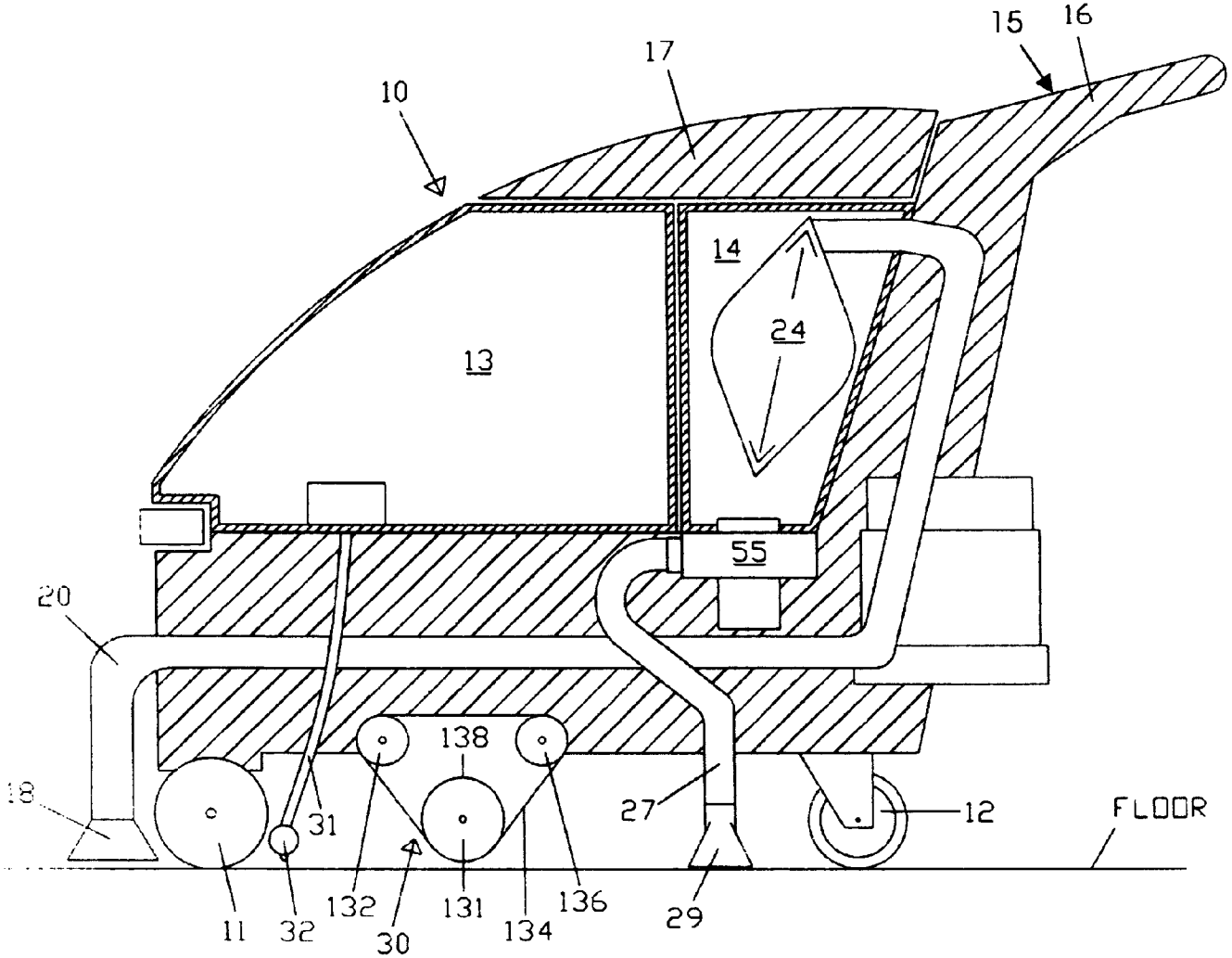
FIG. 6 is a left side schematic view of a fourth embodiment of a floor cleaning machine using a microfiber cloth cleaning element provided in a source roll fed beneath a cylindrical support roller.

Turning now to the embodiment of FIG. 6, it is similar to the embodiment of FIG. 1 except for the microfiber cleaning assembly generally designated 130. Therefore, those elements shown and described in connection with FIG. 1 are repeated with like reference numerals. The microfiber cleaning assembly 130 includes a roller 131 which may be an idler roller (or, if desired, driven by a motor). The roller 131 extends the transverse operating width of the machine. A source roll 132 containing a larger web of microfiber cleaning fabric 134 is located in front of roller 131, and a take-up roll 136 is located to the rear of the roller 131. The take-up roll 136 may be driven by a motor (not shown in FIG. 6). In operation, as the machine moves forward (i.e. to the left in FIG. 6), the take-up roller 136 is driven to wind the microfiber cloth material 134 and gather it. The microfiber cloth material is unwound accordingly from the source roll 132 and fed into contact with the floor F beneath the idler roll 131, the surface of which may contain a resilient layer 138 of a yieldable, yet stiff material such as polyurethane or rubber to maintain the microfiber fabric in contact with the floor surface the entire width of roller 131 and to accommodate irregularities in the floor surface. The microfiber fabric is kept moist by the application of solution from the tank 13 by means of the spray manifold 132.

Having thus disclosed a number of embodiments of improvements for a floor cleaning machine using microfiber material, persons skilled in the art will be able to modify certain of the structure which has been disclosed and to substitute equivalent elements for those illustrated; and it is, therefore, intended that all such modifications and substitutions be covered as they are embraced within the spirit and scope of the appended claims.

We claim:

1. A floor cleaning machine comprising:

a vacuum nozzle located at a front of said machine and extending transverse of the direction of travel of said machine for suctioning materials on a floor in front of said machine;

a tank coupled to said vacuum nozzle;

a vacuum motor for creating a vacuum in said tank to suction loose materials through said vacuum nozzle and convey said materials to said tank;

a filter for filtering particulate matter from air passing through said vacuum nozzle and into said tank;

a floor scrubbing assembly including at least one scrub member located behind said nozzle and including a contact section covered with microfiber cloth and adapted to contact the surface of a floor to be cleaned;

said scrub member comprising two generally flat pads, arranged in staggered relation and overlapping one another in the direction of travel of said machine, each scrub pad having a generally flat bottom surface for contacting the floor, each scrub pad further including a layer of microfiber fabric adjacent the floor and a backing member for supporting said microfiber fabric;

a motor powering said scrub member to move said scrub member such that said microfiber cloth is driven against said floor in scrubbing action; and a source of liquid including a pump for providing a controlled amount of liquid for said scrub member to maintain moisture on the section of said scrub member in contact with the floor; and an exhaust nozzle located to the rear of said machine and delivering filtered air from said vacuum motor onto the floor behind said scrub member.

2. The apparatus of claim 1 further comprising a motor for driving said scrub pads in a vibratory motion.

3. The apparatus of claim 2 wherein said motor for driving said scrub pad rotates said scrub pads in unison in a generally oscillatory motion.

4. The apparatus of claim 3 wherein said drive motor for said scrub pads drives said scrub pads in unison in a reciprocating motion.

5. The apparatus of claim 1 further comprising a vacuum tank, said vacuum motor coupled to said vacuum tank to evacuate the same and to deliver the air evacuated from said vacuum tank to said exhaust nozzle; said filter being in said vacuum tank and filtering air passing therethrough.

6. The apparatus of claim 5 wherein said filter comprises a cloth bag.

* * * * *